US011338193B2

(12) United States Patent
Edmond et al.

(10) Patent No.: US 11,338,193 B2
(45) Date of Patent: May 24, 2022

(54) SNOWBOARD BINDING PROVIDED WITH A BOOT STOP IN A BOTTOM PART OF A SPOILER MOVABLE WITH RESPECT TO A BASE AROUND A ROTATIONAL AXIS

(71) Applicant: NIDECKER SA, Rolle (CH)

(72) Inventors: Jean-Pierre Edmond, Annemasse (FR); Daniel Schmäh, Etoy (CH); Henry Nidecker, Bougy-Villars (CH); Xavier Nidecker, Rolle (CH)

(73) Assignee: NIDECKER SA, Rolle (CH)

( * ) Notice: Subject to any disclaimer, the term of this patent is extended or adjusted under 35 U.S.C. 154(b) by 0 days.

(21) Appl. No.: 17/260,009

(22) PCT Filed: Jul. 20, 2019

(86) PCT No.: PCT/EP2019/069605
§ 371 (c)(1),
(2) Date: Jan. 13, 2021

(87) PCT Pub. No.: WO2020/020797
PCT Pub. Date: Jan. 30, 2020

(65) Prior Publication Data

US 2021/0308553 A1 Oct. 7, 2021

(30) Foreign Application Priority Data

Jul. 22, 2018 (FR) ..... 1870850

(51) Int. Cl.
*A63C 9/00* (2012.01)
*A63C 10/28* (2012.01)
(Continued)

(52) U.S. Cl.
CPC ..... *A63C 10/28* (2013.01); *A63C 10/045* (2013.01); *A63C 10/103* (2013.01); *A63C 10/24* (2013.01)

(58) Field of Classification Search
CPC ..... A63C 10/00; A63C 10/28; A63C 10/045; A63C 10/24
See application file for complete search history.

(56) References Cited

U.S. PATENT DOCUMENTS 5,918,897 A 7/1999 Hansen et al.
5,997,027 A * 12/1999 Jungkind ..... A63C 10/045 280/14.21

(Continued)

FOREIGN PATENT DOCUMENTS

EP 3 800 847 A2 10/1997
EP 0824942 A1 2/1998

(Continued)

OTHER PUBLICATIONS

International Search Report and Written Opinion dated Oct. 11, 2019 in corresponding International application No. PCT/EP2019/069605; 15 pages.

(Continued)

*Primary Examiner* — Brian L Swenson
(74) *Attorney, Agent, or Firm* — Maier & Maier, PLLC

(57) ABSTRACT

A snowboard binding with a base, a bearing shell movable about a first rotary pin supported by the base, and a pedal for controlling the bearing shell from an open position to a closed position, the bearing shell including a shell bottom and two shell sides supporting the pedal. The first rotary pin is supported by the bearing shell to form a boot stop in the shell bottom in any position of the bearing shell lying between an open position and the closed position. The shell bottom can support a bearing and the base, a pin housed in the bearing to form a hinge extending along the axis of rotation of the first rotary pin. The pedal can move relative to the shell sides about a second axis of rotation and be supported by two arms.

8 Claims, 13 Drawing Sheets

(51) Int. Cl.

| | |
|---|---|
| ***A63C 10/04*** | (2012.01) |
| ***A63C 10/10*** | (2012.01) |
| ***A63C 10/24*** | (2012.01) |

(56) References Cited

U.S. PATENT DOCUMENTS

| | | | | |
|---|---|---|---|---|
| 6,002,893 | A | 12/1999 | Caruthers, Jr. et al. | |
| 6,065,770 | A * | 5/2000 | Hansen | A63C 10/04 280/14.21 |
| 6,464,237 | B1 * | 10/2002 | Gracie | A63C 10/045 280/14.24 |
| 10,561,926 | B2 * | 2/2020 | Flannery | A63C 10/04 |
| 2002/0101064 | A1 * | 8/2002 | Freisinger | A63C 10/045 280/624 |
| 2006/0027981 | A1 * | 2/2006 | Pascal | A63C 10/24 280/14.22 |
| 2007/0182130 | A1 * | 8/2007 | Laser | A63C 10/04 280/619 |
| 2010/0133787 | A1 * | 6/2010 | Cunningham | A63C 10/285 280/624 |
| 2010/0133788 | A1 * | 6/2010 | Cunningham | A63C 10/285 280/624 |

FOREIGN PATENT DOCUMENTS

| | | | |
|---|---|---|---|
| EP | 0890376 | A2 | 1/1999 |
| EP | 1 596 948 | A1 | 11/2005 |
| FR | 2 749 181 | A1 | 12/1997 |
| WO | 9915245 | A1 | 4/1999 |
| WO | 2008094974 | A1 | 8/2008 |

OTHER PUBLICATIONS

International Preliminary Report on Patentability dated Apr. 14, 2020 of corresponding International Application No. PCT/EP2019/069605; 11 pgs.

* cited by examiner

SNOWBOARD BINDING PROVIDED WITH A BOOT STOP IN A BOTTOM PART OF A SPOILER MOVABLE WITH RESPECT TO A BASE AROUND A ROTATIONAL AXIS

The present invention relates to a family of bindings for holding a boot securely attached to a snowboard in a way to put on the boot more easily.

Snowboards users are often constrained to release one of their boots, for example to use the motorized lifts. The bindings generally comprise two straps to be released in order to detach and to be tightened in order to put the boot on.

These operations are laborious and manufacturers have sought solutions to these drawbacks.

These searches have given rise to rear entry bindings that include one or more holding straps. Such bindings are known, for example, from documents EP 1 596 948, EP 0 800 847 and U.S. Pat. No. 5,918,897, in which the closing of the binding is obtained by a manual action of the user on a suitable means. This type of binding is designated in this document by "rear entry binding".

It is also possible to close a rear entry binding by pressing a pedal. This type of rear entry binding is designated in this document by "automatic rear entry binding".

Document FR 2 749 181 thus discloses an automatic rear entry binding comprising a base, a spoiler rotatable around an axis of rotation fixed to the base and a pedal. The spoiler comprises a shell base and two shell sides. The first axis of rotation is held by the shell sides, by means of connecting means, in this case rivets, arranged on each side of an opening of the shell base. The latter acts as a boot stop, i.e. comes to lean against the boot of a user but only in the closed position. The pedal is held by the two shell sides, which thus form two arms integral with the spoiler, in order to control it from an open position to a closed position. The pedal is a bar arranged in the width of the base and fixed to the two arms.

Another example of an automatic rear entry binding, in which the pedal is held by two arms which are integral with the spoiler is provided by document EP 0 890 376. The spoiler comprises a shell base and two shell sides. The first axis of rotation is held by the base and the shell sides. The pedal comprises in this case a bar arranged in the width of the base and fixed to the shell sides, which thus act as two arms, and comprises a base which rotates around the bar.

Document EP 0 824 942 discloses an automatic rear entry binding comprising a base, a spoiler which rotates relative to the base around an axis of rotation, from an open position and to a closed position, and a pedal. The spoiler comprises a shell base and two shell sides. The axis of rotation is held by the base and the shell sides. The pedal, in this case a bar arranged in the width of the base, is hinged to the spoiler about the axis of rotation by two supporting arms.

Document U.S. Pat. No. 5,997,027 discloses a snowboard binding wherein a spoiler comprises a concave shell base and two shell sides and rotates around an axis of rotation, by means of two spindles inserted in bearings held by the shell sides and two sides of a base. The axis of rotation extends inside the concavity of the shell base, so that the spindles can serve as lateral boot stops, depending on the actual form of the boot's heel.

Document WO 2008/094974 discloses an automatic rear entry binding comprising a base, a spoiler which rotates relative to the base around a first axis of rotation and a pedal. The spoiler comprises a shell base and two shell sides. The first axis of rotation is held by the base and shell sides. The pedal is hinged to the spoiler by two supporting arms in order to control the spoiler from an open position to a closed position. The supporting arms rotate relative to the spoiler around a second axis of rotation and are hinged to the base by a pivot-type connection.

Another example of an automatic rear entry binding in which the pedal is held by arms which rotate relative to the spoiler around a second axis of rotation and are hinged to the base by a pivot-type connection is provided by document U.S. Pat. No. 6,002,893. The spoiler comprises a shell base and two shell sides. The first axis of rotation is held by the base and the shell sides. The arms which hold the pedal and the spoiler act together as a toggle joint with respect to the first rotation axis and the pivot-type connection.

Document WO 99/15245 discloses a snowboard binding, comprising a base, a spoiler and an axis of rotation held by the base. The spoiler comprises a shell base and two shell side. A latch rotates around the axis of rotation to serve as a locking stop in the closed position, at the end of the fitting. The spoiler rotates around the axis of rotation through a support, from a service position, in which it prevents a rearward movement of a user's boot, in a storage position, in which it is folded over the base.

The present invention finds its source in the search for an automatic rear entry binding, whose objective is to minimize as low as possible the force required to rotate the spoiler in the closed position to satisfactory achieve efficiency and comfort.

For this purpose, the subject of the invention is a snowboard binding, comprising a base, a spoiler which rotates around a axis of rotation held by the base, a pedal and a strap which control the spoiler for closing and opening respectively between an open position and a closed position and in which the spoiler comprises a shell base and two shell sides, the pedal rotates with respect to the two shell sides and the strap is hinged to the pedal or the spoiler, characterized in that the shell base or the base comprises a bearing hinged around the axis of rotation to serve as a boot stop in any position of the spoiler during closing or opening between the open position and the closed position.

The boot stop formed in the shell base by this first axis of rotation makes it possible to guide and pre-position the boot of a user with respect to the base. Thus, the boot positioning relative to the base begins as soon as the spoiler assumes an open position for which the boot contacts the shell base and maintains the positioning until it reaches the closed position.

It should be recalled that the sliding of a boot relative to the base of a snowboard binding requires a significant effort from a user. The guiding and pre-positioning effect conferred by the boot stop, formed in the shell base by the first axis of rotation as previously mentioned, makes it possible to use all the pressure to actuate the pedal with increased efficiency and to move the spoiler around the first axis of rotation in the closed position. The same applies to a clamping action or if one wants to lock this position.

According to a particular embodiment of the invention, the boot stop is formed in the shell base by a hinge along the axis of rotation, which comprises a bearing supported by the shell base or the base and a pin, held by the base or the shell base respectively and inserted in the bearing. Preferably, the shell base has an opening in front of the bearing. Preferably, the outer surface of the bearing is determined by a concave generatrix.

According to the invention, the bearing may comprise a roller provided with an outer surface determined by a concave generatrix. This arrangement provides for a better guiding and pre-positioning of the boot by the boot stop formed by the hinge in the shell base.

The pedal can be fixed to the shell sides or can also be moved about a second axis of rotation held by said sides.

Advantageously, the pedal is held by two arms, freewheel connected to the second axis of rotation or connected to the base in such a way as to allow them to move forward or backward in combination with a rotational movement around said second axis of rotation.

The expression "freewheel connected" means that the pivoting of the arms around the second axis of rotation only is limited by the size of the spoiler itself.

The freewheel assembly or the forward and backward movement of the arms relative to the base allows the pedal to follow the pressing of the user's heel from the open position to the closed position. This arrangement ensures a complete closing of the snowboard binding according to the invention, since the pressing of the user produces a motor torque up to the end of the displacement. From where it follows a greater efficiency of the pedal action and a greater comfort of using the binding.

In order to allow them to move forward and backward, the invention provides that the arms which hold the pedal are hinged to the base by connecting rods. The invention also provides said arms are hinged to the base by an oblong or curvilinear guide, and a pin inserted in the guide, one of these two elements being part of the arms while the other is part of the base.

Other advantages of the invention are discussed below in reference to various embodiments illustrated by the drawings.

Figure 1:
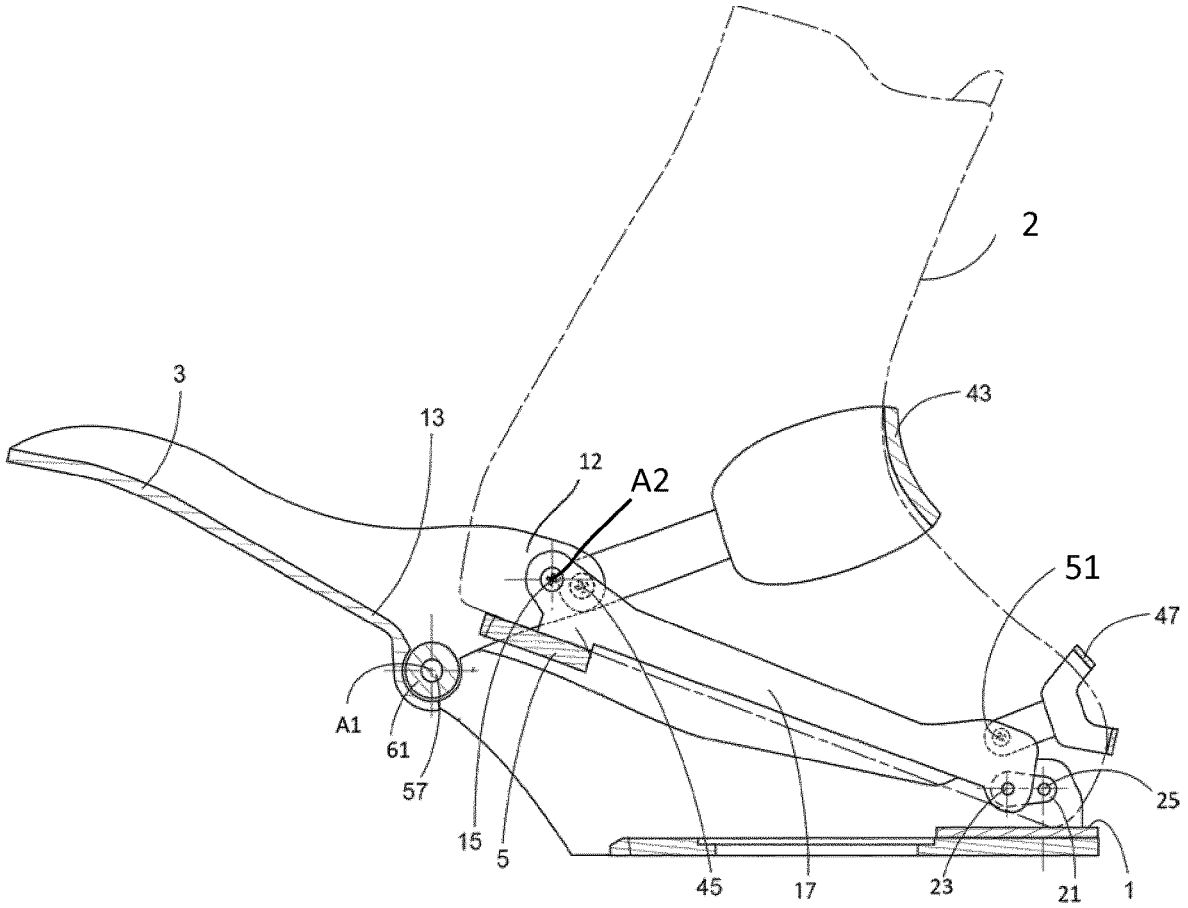
FIG. 1 shows a side view of a snowboard binding according to a first embodiment of the invention, in an initial open position.

The invention now is described with the help of the various embodiments mentioned above. An element common to these modes is designated by the same reference.

A snowboard binding comprises, according to either of the various embodiments, a base 1, a spoiler 3 and a pedal 5.

The base 1 is intended to be fixed to a snowboard (not shown) and comprises a front part 7, that receives the toe of the user's snow boot 2 and a rear part 9, integral with the front part or not, which holds a first axis of rotation A1. A rotatable spoiler 3 pivots relative to the base 1 about this first axis of rotation A1, from an open position to a closed position. A rotatable pedal 5 pivots relative to the spoiler 3 around a second axis of rotation A2, in order to control it from an initial or intermediate open position to the closed position.

Figure 2:
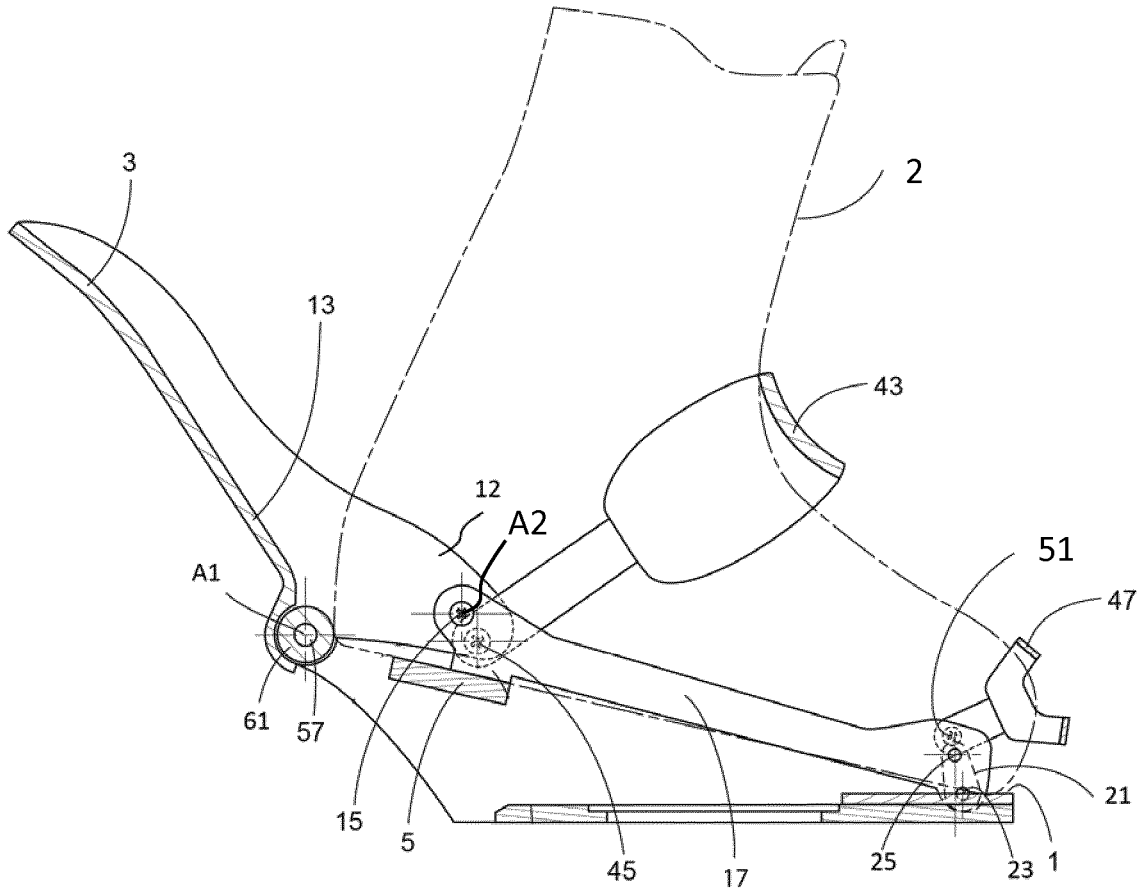
FIG. 2 shows the binding of FIG. 1 in an intermediate open position.
Figure 3:
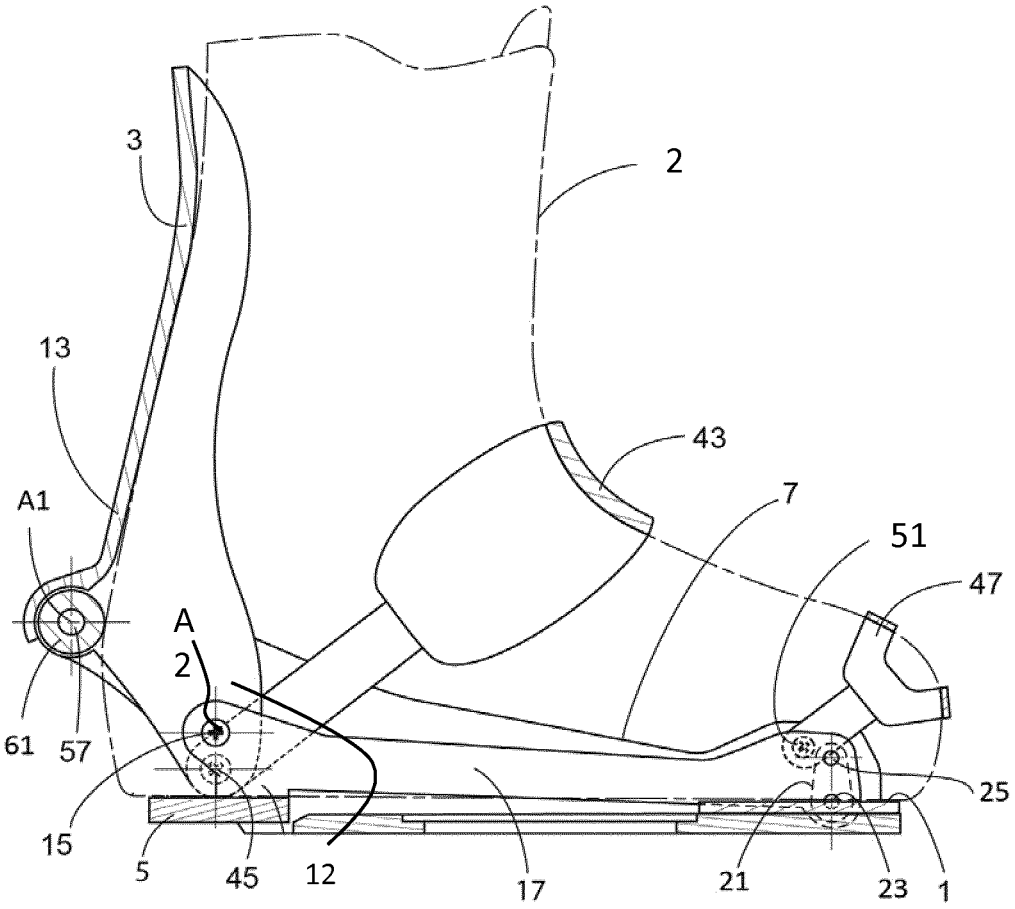
FIG. 3 shows the binding of FIG. 1, in a closed position.

The spoiler 3 comprises, FIGS. 1 to 3, a concave shell base 13 and two shell sides 12 which hold the second axis of rotation A2. The shell base 13 preferably has a concave shape for receiving the heel of the boot 2 of the user.

The initial or intermediate open position and the closed position of the spoiler 3 are defined by angular values about the axis of rotation A1. The angular value of the open position is greater than the angular value of the closed one, considering the base 1 as a common reference of the two positions.

A boot stop is formed in the shell base 13 by a hinge along the first axis of rotation A1, comprising a bearing 61 supported by the shell base 13 and a pin 57 held by the base 1 and inserted in the bearing 61. The boot stop, as explained above, allows the user to guide and pre-position the boot 2, in any position form the intermediate open position, FIG. 2, to the closed position, FIG. 3. Thus, during the ultimate closing phase, no horizontal sliding of the boot relative to the base is observed. The intermediate open position is defined by the first contact of the user's boot with the boot stop as the spoiler 3 is pivoting about the first axis of rotation A1.

In one embodiment, the shell base 13 is cut in front of the bearing 61 in order to allow the latter to play the role of a boot stop.

The pedal 5 preferably is fixed to two arms 17 which rotate around the second axis of rotation A2 by connecting means such as rivets 15 inserted in bores 16. The pedal 5 controls the spoiler 3 in the closed position in an automatic manner, without manual intervention. The arms 17 transmit a pressure exerted on the pedal 5 by the user's boot 2 to the spoiler 3, thus producing a motor torque from the initial opening position to the closed position.

According to the first, second, and fourth embodiments, the arms 17 are connected to the base 1 in such a way as to allow them to move forward or backward in a combined movement with the rotational movement about the second axis of rotation A2. According to the third, fifth and sixth embodiments, the arms 17 to which the pedal 5 is fixed enable a free wheel rotation about the second axis of rotation A2. However, the free wheel rotation of the arms 17 also applies to the embodiments for which the arms are connected to the base in such a way as to allow them to move forward or backward. Also, the connection of the arms to the base allowing this forward and backward movement may be implemented with the embodiments for which the arms experience a free wheel rotation.

In all illustrated embodiments, the pedal 5 is fixed to the arms 17. However, the pedal 5 may also be rotatable around a bar which is fixed to the arms 17. The invention also provides for a pedal 5 split into two parts, each fixed to an arm 17.

Figure 5:
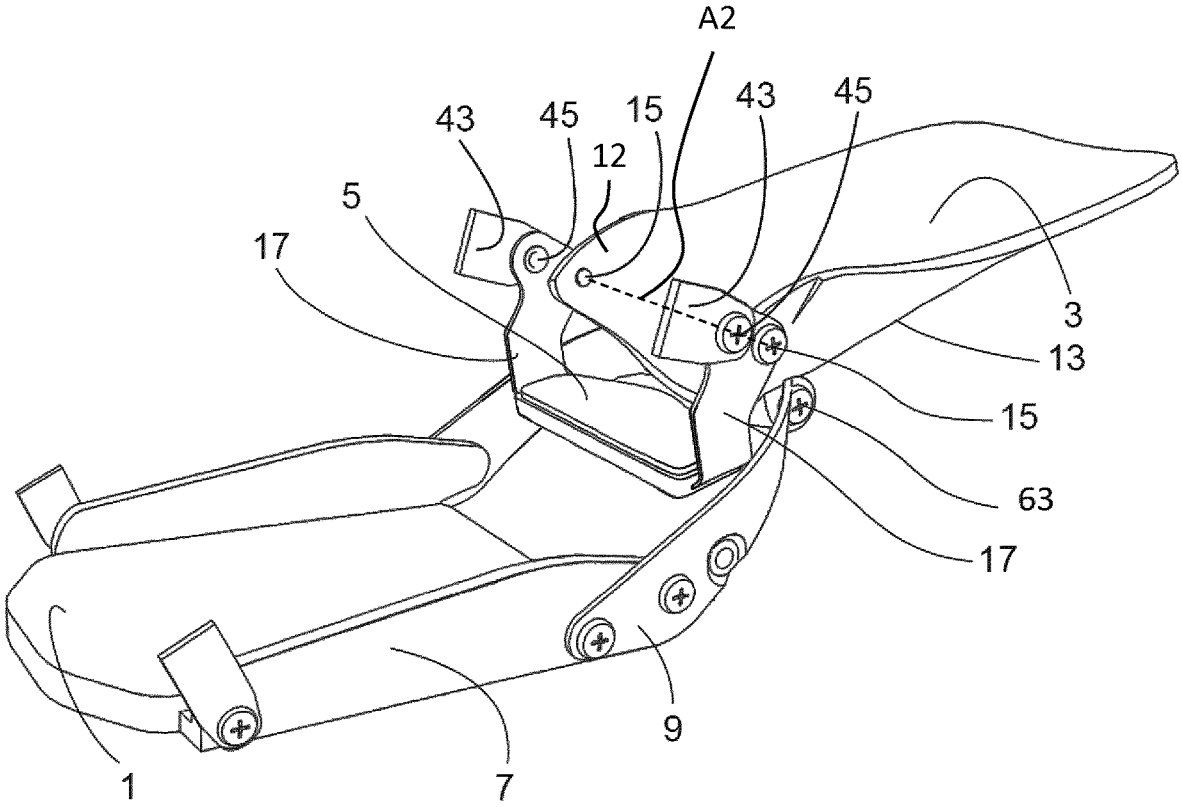
FIG. 5 shows a perspective view of a snowboard binding according to a third embodiment of the invention, in an open position.
Figure 7:
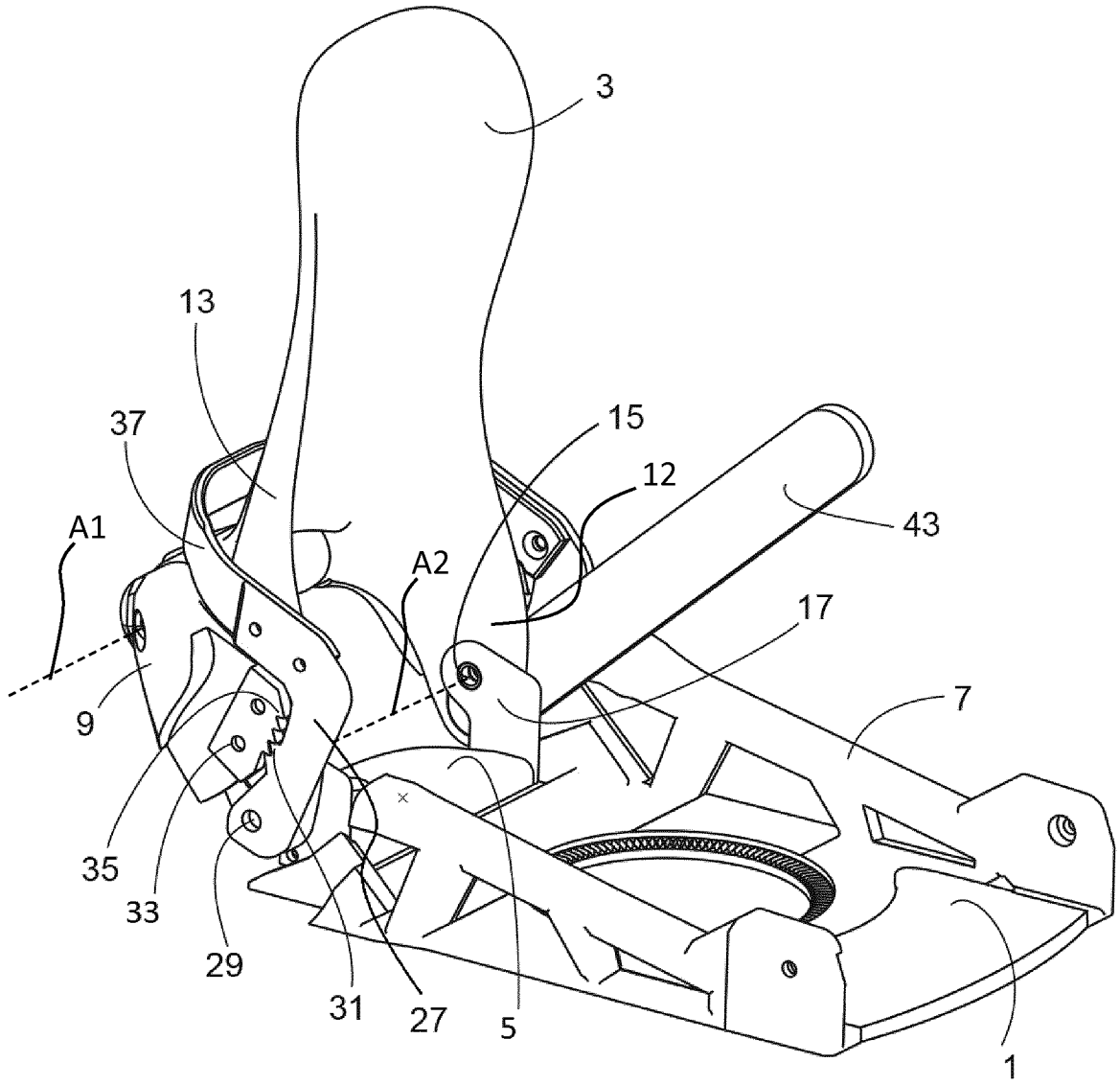
FIG. 7 shows a perspective view of a snowboard binding according to a fifth embodiment of the invention, in a closed position.
Figure 8:
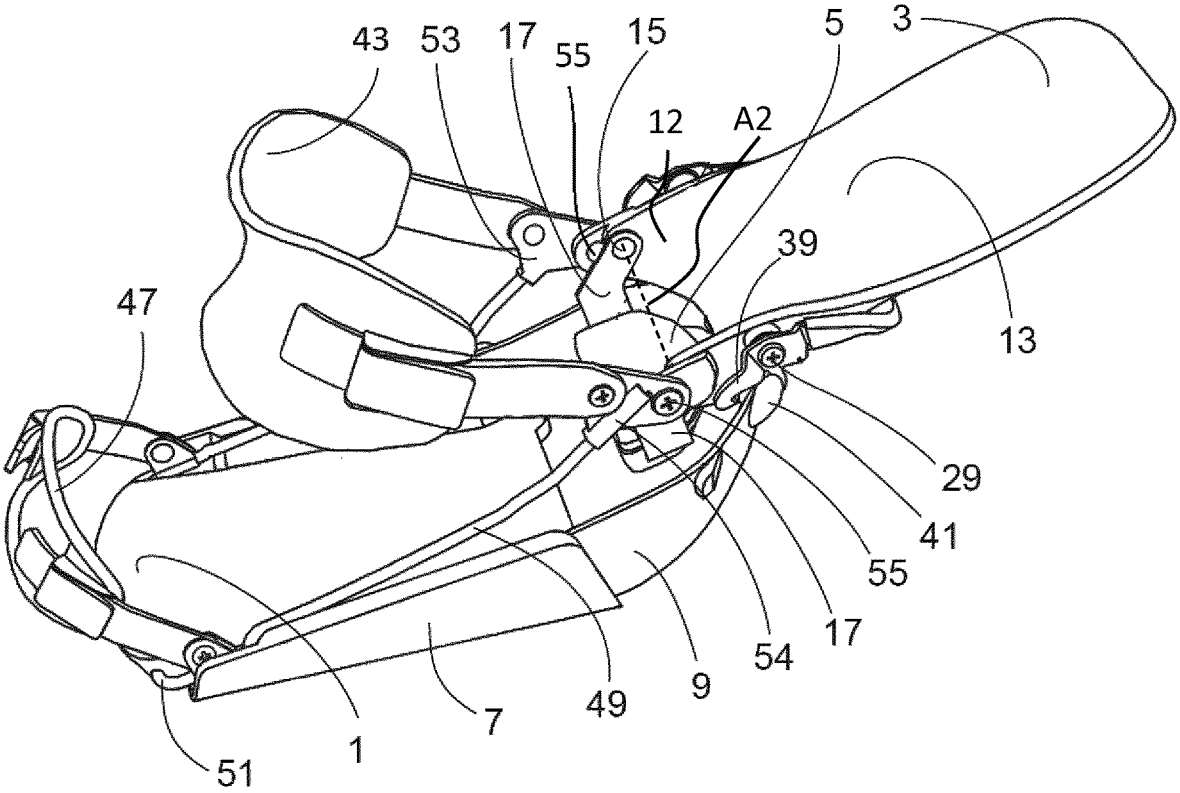
FIG. 8 shows a perspective view of a snowboard binding according to a sixth embodiment of the invention, in an open position.

In the embodiments for which the arms 17 experience a free wheel rotation, illustrated by FIGS. 5, 7 and 8, the connecting means 15, 16 along the second axis of rotation A2 ensure the guiding of the pedal 5 as it rotates freely with respect to the base 1, so that it follows the boot sole movement during fitting.

According to the first and fourth embodiments, two connecting rods 21 are hinged to the arms 17 and the base 1 in order to increase the guiding accuracy of the pedal 5. The respective articulations comprise connecting means 23 and 25. Due to the guiding, the arms 17 are moved forward towards the front part 7 of the base 1 and then backward towards the rear part 9 of the base 1, as the spoiler 3 rotates about the first axis of rotation A1. In other words, the connecting rods 21 accompany a horizontal component of the movement of the arms 17 during the rotation of the spoiler 3 around the first axis of rotation A1.

Figure 6:
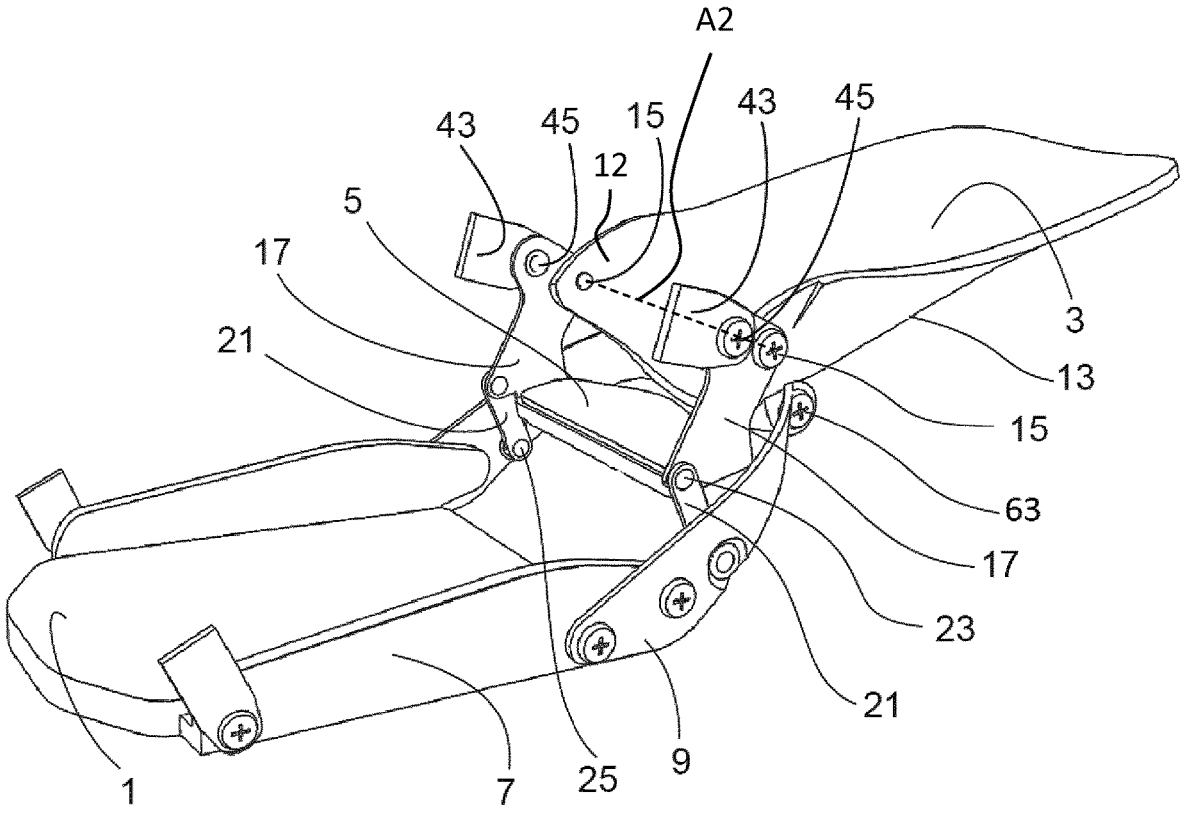
FIG. 6 shows a perspective view of a snowboard binding according to a fourth embodiment of the invention, in an open position.

According to the first embodiment, FIGS. 1 to 3, the connecting rods 21 are hinged to the front part 7 of the base 1. This embodiment advantageously produces, in the open position, the loosening of a front strap, as it will be explained further. According to the fourth embodiment, FIG. 6, the connecting rods 21 are hinged to the rear part 9 of the base 1.

Figure 4:
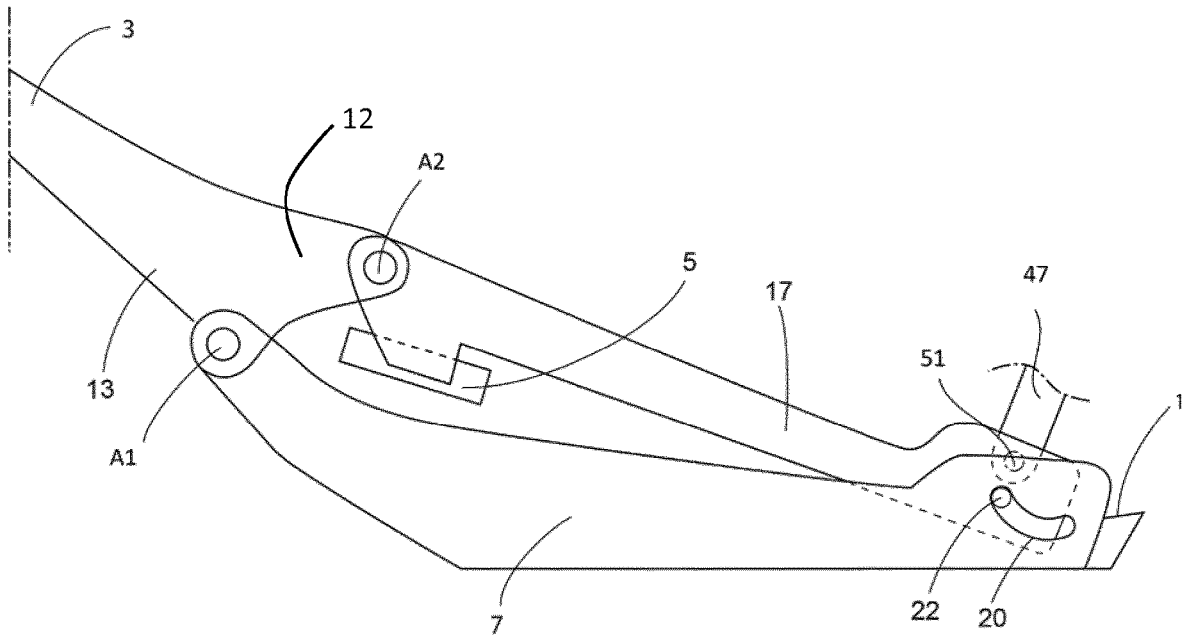
FIG. 4 shows a side view of a snowboard binding according to a second embodiment of the invention, in an open position.

According to the second embodiment, illustrated in FIG. 4, the arms 17 are articulated to the base 1 by a guide 20 held by the base 1 and a pin 22 supported by the arms 17 and inserted in the guide 20. The guide 20 may be oblong or curvilinear, as illustrated in FIG. 4. This articulation produces the same effect as the connecting rod described above, namely a forward movement of the arms 17 towards the front part 7 of the base 1 and then a backward movement towards the rear part 9 of the base 1, during the rotation of the spoiler 3 around the first axis of rotation A1.

The length of the arms 17, measured from the pedal 5 to the connecting means 15, 16 along the second axis of rotation A2, preferably is chosen so that the pedal 5 comes into direct contact with the snowboard in the closed position. This arrangement facilitates the removal of snow that may accumulate on the base 1 in the open position. In addition, the direct contact of the pedal 5 with the snowboard enhances the transmission of the pressure from the user's heel. This direct contact applies to the six embodiments of the invention.

A snowboard binding according to the invention comprises means for maintaining the spoiler ii the closed position.

A first example of such a means is described with reference to the fifth embodiment illustrated in FIG. 7, but this example also applies to other embodiments. The locking means comprises a lever 27 hinged to the spoiler 3 by a link 29 for pivoting against an elastic return means (not shown). The lever 27 is provided with notches 31 and cooperates with a retaining element 33, fixed relative to the rear part 9 of the base 1 and provided with notches 35. The respective notches 31 and 35 of the lever 27 and the retaining element 33 are oriented to prevent the pivoting of the spoiler 3 in the opening position, thus blocking it in the closed position.

It should be noted that the notches 31 and 35 determine several closing positions. This arrangement enables the binding to be locked even in presence of possible snow accumulated under the pedal 5 or under the user's boot.

Unlocking is caused by manual action on the lever 27, for example by means of a flexible link (not shown), in order to release the notches 31 and 35. The lever 27 may be arranged on one side of the spoiler 3, that is to say on the side of one of the two means 15, 16 which connect the spoiler 3 and the arms 17. It can also be arranged on both sides of the spoiler 3. In this case, it may be shaped like a hoop 37 and act symmetrically.

A second example is described with reference to the sixth embodiment illustrated in FIGS. 8 and 9, but here again, this example applies to other embodiments. It differs from the previous example in that the lever 27 comprises a beak 39 instead of notches and cooperates with a raised retaining element 41 fixed to the rear part 9 of the base 1. Note the reference 42 of an elastic return means of the lever 27, namely a spring disposed around the link 29 between the lever 27 and the spoiler 3.

This second example of locking means allows only one locked position.

In these examples, it is possible to interchange the roles of the lever and the raised element, so that the lever is hinged to the base and co-operate with an element fixed on the spoiler.

A retaining strap 43, integral or arranged in correspondence with the ankle of a user's boot, is hinged by a connection means 45 to each arm 17. Where the binding comprises several straps, for example a front strap 47 and an ankle strap 43, the front strap 47 is hinged to the front part 7 of the base 1 while the ankle strap 43 is hinged to the pedal 5 by the arms 17. Preferably, in the intermediate open position, FIG. 2, or the initial open position, FIG. 1, the connection means 45 is arranged on the arms 17 at a distance from the first axis of rotation A1, greater than the distance between the first A1 and the second A2 axis of rotation, so as to develop the arms movement relative to the spoiler movement.

The invention also provides a means for raising the front strap 47 in the open position, in order to enable the binding to be fit more easily.

According to the first embodiment, FIGS. 1 to 3, the front strap 47 rotates around a hinge 50 with respect to the arms 17 which hold the pedal 5. Since the arms 17 are also hinged to the base 1 by the connecting rod 21, the rotation of the arms 17 around the second axis of rotation A2 in the initial opening position, FIG. 1, drives the front strap 47 in a loosening movement determined by the backward movement of the arms 17. In other words, the front strap 47 moves from a tightening position to a loosening position, respectively determined by a forward position of the arms 17 in the closed position of the spoiler 3 and a backward position of the arms 17 in the initial open position of the spoiler 3.

The backward movement of the arms 17 in the initial open position may also determine a loosening of a front strap according to the second embodiment. As illustrated in FIG. 4, the articulation between the curvilinear guide 20 held by the base 1 and the pin 22 supported by the arms 17 and inserted in the curvilinear guide 20 enables the backward movement of the arms 17 and the loosening of the front strap 47.

Figure 9:
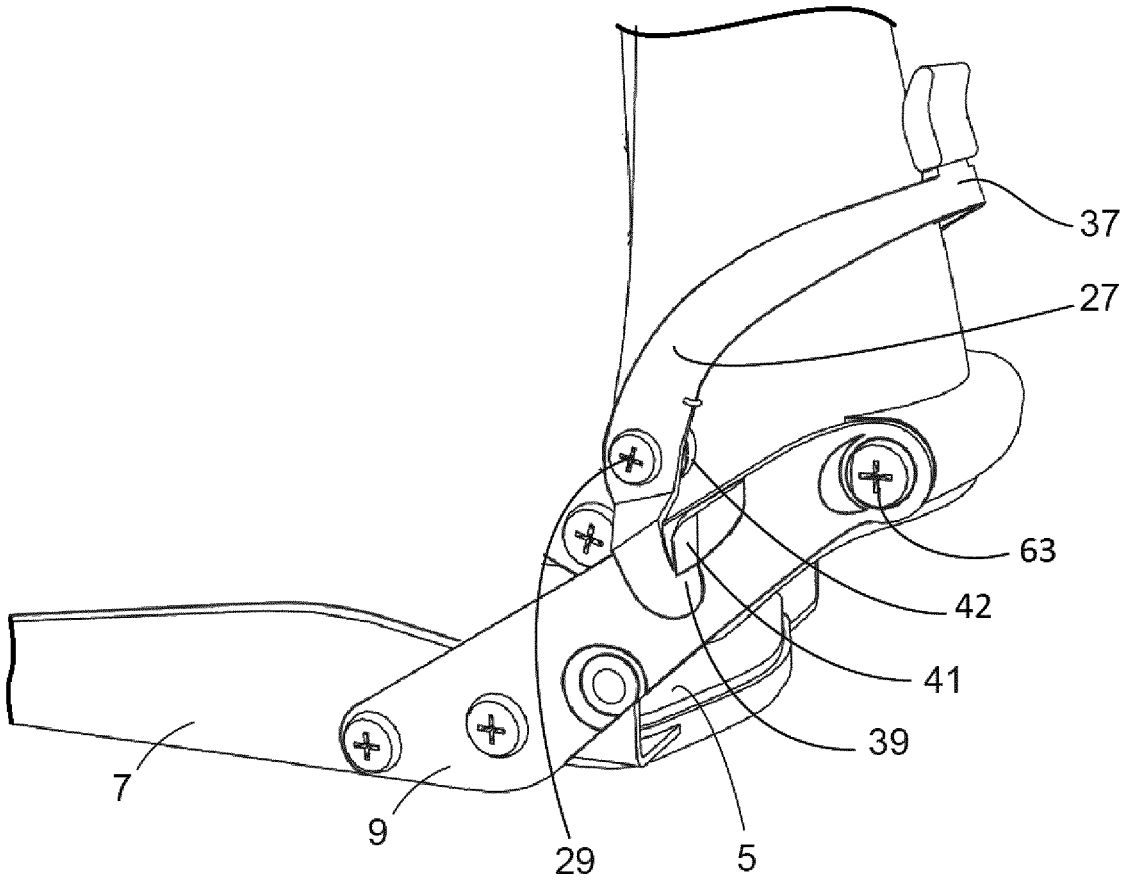
FIG. 9 show an enlargement of FIG. 8.
Figure 10:
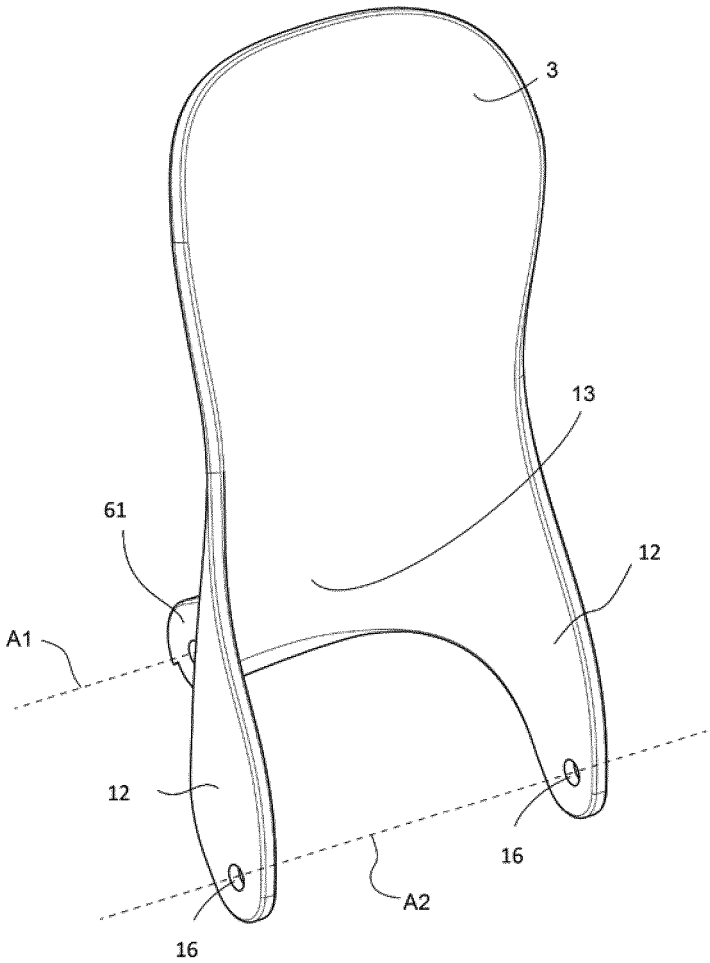
FIG. 10 shows a perspective view of a spoiler according to a first embodiment of the invention.

According to the sixth embodiment illustrated in FIGS. 8 and 9, the front strap 47 pivots with respect to a lever 49, which is hinged to the base 1 by a connection means 51 and connected to the transmission element 53 by a sliding connection 54, which allows a path difference between the transmission element 53 and the lever 49. The movement of the lever 49 is thus slaved to the rotation of the spoiler 3 in order to raise the ankle strap 43 and the front strap 47 when the spoiler 3 rotates in the open position.

Since the movement of the spoiler 3 is transmitted to the lever 49 by means of the connection means 55, the invention provides for arranging this connection means 55 in such a way that, in the open position, it is at a distance from the first axis of rotation A1, greater than the distance between the first and the second axis of rotation A2, so as to develop the movement of the lever 49 relative to the movement of the pedal 5.

The lever 49 may be attached to the transmission member 53 in a rigid manner, provided that the connection 51 comprises an oblong hole for accompanying the horizontal component of the transmission element movement 53 during the rotation of the spoiler 3. The lever 49 may also be connected to the spoiler 3 by an oblong hole.

FIGS. 10 to 13 more particularly illustrate the spoiler of the various embodiments of the snowboard binding.

The spoiler 3 comprises a shell base 13, two shell sides 12 and a first axis of rotation A1. This axis of rotation A1 is held by a hinge bearing 61 that acts as a boot stop of the shell base 13, in any position of the spoiler 3 around the first axis of rotation A1, from an angular open position to an angular closed position.

Figure 11:
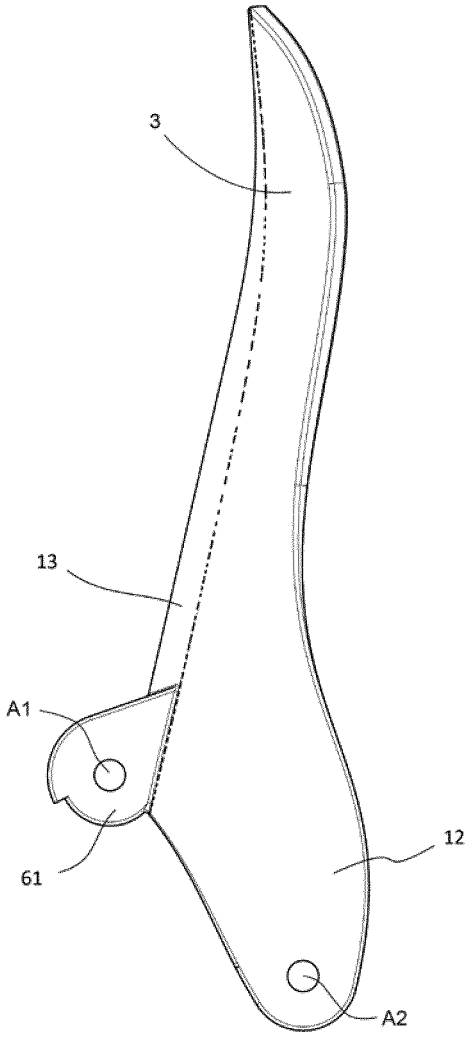
FIG. 11 shows a side view of the spoiler shown by FIG. 10.
Figure 12:
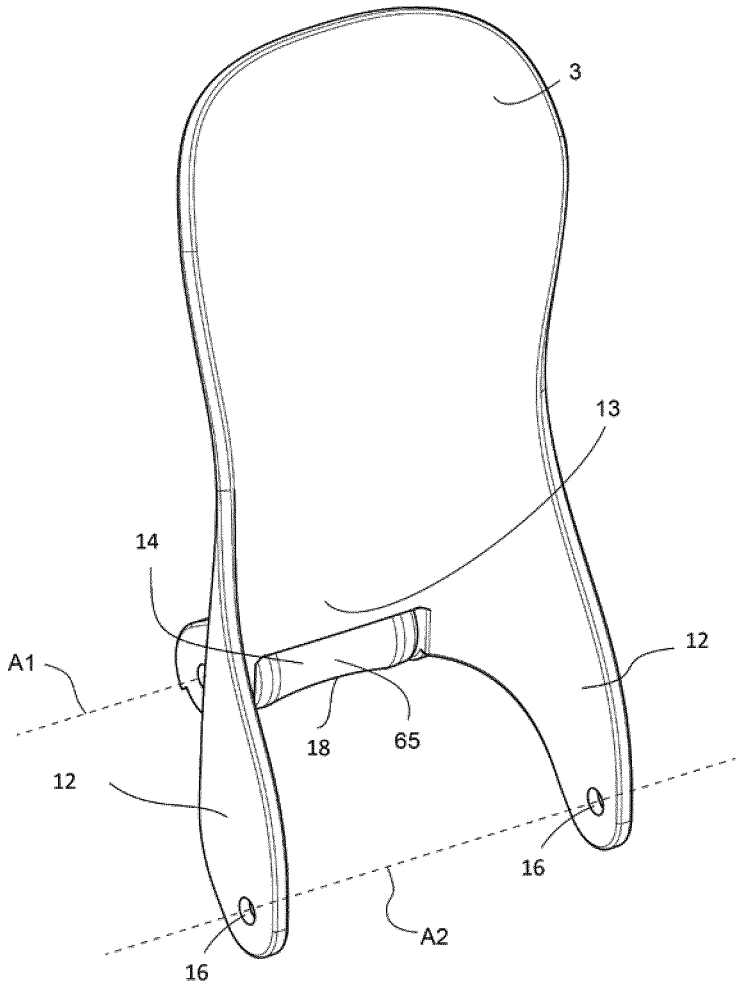
FIG. 12 shows a perspective view of a spoiler according to a second embodiment of the invention.
Figure 13:
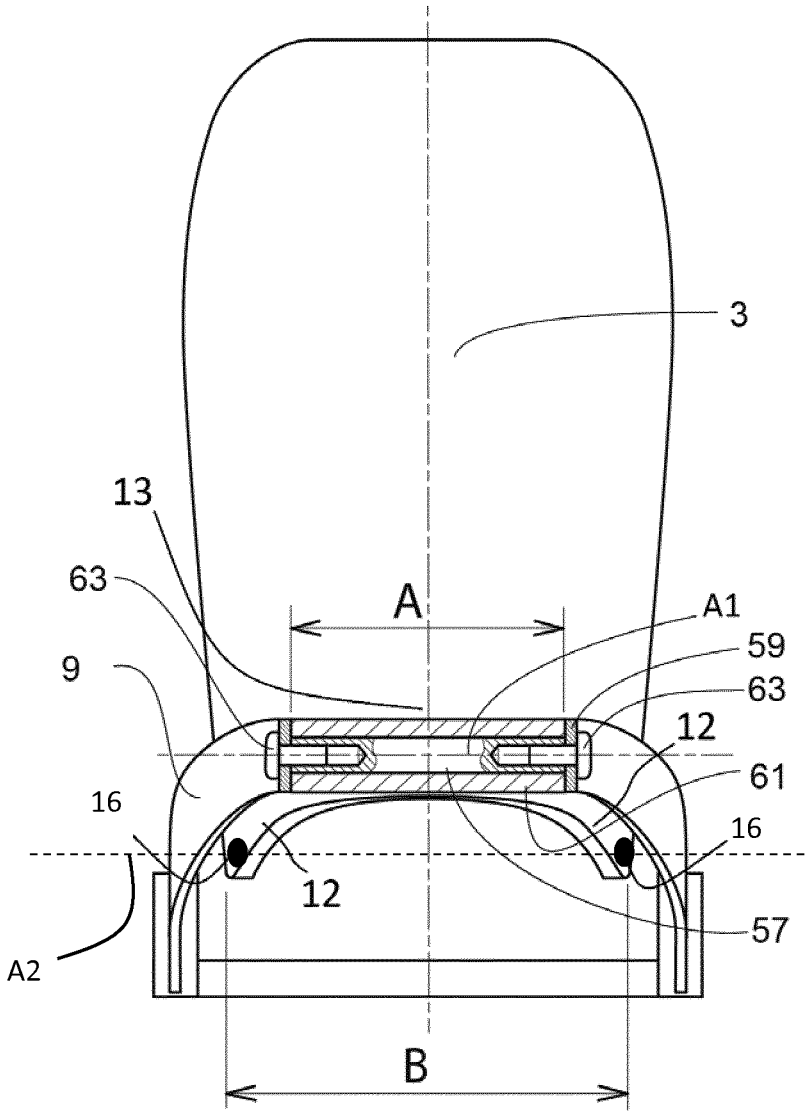
FIG. 13 shows a rear view of the spoiler shown by FIG. 10 or 12 in a closed position and a base to which the spoiler is hinged.

In a first embodiment of the spoiler, FIGS. 11 and 12, the shell base 13 itself acts as a boot stop for guiding and pre-positioning the boot of a user.

Preferably, FIG. 12, the shell base 13 comprises an opening 14 which faces the bearing 61 so that the latter acts as a boot stop. In this second embodiment, the bearing 61 or a roller 65 which rotates with respect to the bearing 61 may advantageously be provided with an outer surface determined by a concave generatrix for centring the user's boot.

A hinge along the first axis of rotation A1 is provided by a pin 57 held by the base 1 and inserted in the bearing 61 supported by the shell base 13. The pin 57 is fixed to a base support 59 by screws 63. It should be noted that, for a good integration of the binding elements, FIG. 4, the rear part 9 of the base 1 may have a hoop shape, provided that the width A of the hinge, measured along the pin 57, is less than the width B of the spoiler 3, measured along the second axis of rotation A2 between the receiving bores 16 of the rivets 15 used to hinge the pedal 5.

The invention claimed is:

1. A snowboard binding, comprising: a base longitudinally extending along a rear entry direction, a spoiler which rotates around an axis of rotation held by the base, a pedal and a strap which controls the spoiler for closing and opening respectively between an open position and a closed position, in which the spoiler comprises a concave shell base and two shell sides, the pedal rotates with respect to the two shell sides and the strap is bound to the pedal or the spoiler, characterized in that the concave shell base or the base comprises a bearing hinged around the axis of rotation and wherein the axis of rotation extends outside of the shell base concavity, so that the bearing serves as a transversal boot stop with respect to the longitudinal rear entry direction, in any position of the spoiler during closing or opening, between the open position and the closed position.

2. A snowboard binding according to claim 1, wherein the concave shell base comprises an opening in front of the bearing.

3. A snowboard binding according to claim 2, wherein the bearing comprises a roller.

4. A snowboard binding according to claim 2, wherein the bearing or the roller is provided with an outer surface determined by a concave generatrix.

5. A snowboard binding according to claim 1, wherein the pedal is held by two arms and wherein two connecting rods are hinged to the arms and to the base to guide the arms with respect to the base.

6. A snowboard binding according to claim 5, wherein the arms which hold the pedal are hinged to the base by an oblong or curvilinear guide and a pin inserted in the guide, one of these two elements being part of the arms while the other is part of the base.

7. A snowboard binding according to claim 5, further comprising a second strap which is bound to the arms which hold the pedal in such a way as to be driven in a tightening position and a loosening position which are respectively determined by a forward position of the arms when the spoiler is in the closed position and a backward position of the arms when the spoiler is in the open position.

8. A snowboard binding according to claim 1, further comprising a lever which is hinged either to the spoiler or to the base, a return means counteracting the rotation of the lever and a retaining means which is respectively fixed to the base or the spoiler, said lever and retaining means being provided with locking means for blocking the spoiler in the closed position.

* * * * *